US005454516A

United States Patent [19]

Smyrl

[11] Patent Number: 5,454,516

[45] Date of Patent: Oct. 3, 1995

[54] SHOWERHEAD WITH SELECTABLE LIQUID DISPENSER

[76] Inventor: W. M. Smyrl, 5401 31st St., Lubbock, Tex. 79407

[21] Appl. No.: 215,098

[22] Filed: Mar. 21, 1994

[51] Int. Cl.[6] ..... B05B 7/32

[52] U.S. Cl. ..... 239/305; 239/307; 239/310; 239/581.1

[58] Field of Search ..... 239/304, 305, 239/10, 310, 307, 379, 581.1; 137/572, 625.17, 625.18, 625.41, 628, 630.13, 897

[56] References Cited

U.S. PATENT DOCUMENTS

| | | | |
|---|---|---|---|
| 2,564,618 | 8/1951 | Williams | 239/310 X |
| 3,091,402 | 5/1963 | Palmer | 239/305 X |
| 3,110,423 | 11/1963 | Hegedic et al. | 239/305 X |
| 4,218,013 | 8/1980 | Davison | 239/305 X |
| 5,135,173 | 8/1992 | Cho | 239/310 X |

*Primary Examiner*—Andres Kashnikow
*Assistant Examiner*—Kevin P. Weldon

[57] ABSTRACT

Disclosed is a new showerhead with selectable liquid dispenser for selectively dispensing one of a plurality of viscous liquids, such as soap and shampoo, available at the showerhead into the water stream of the showerhead during use thereof. The showerhead with selectable liquid dispenser comprises a generally conical hollow spray head body having a plurality of openings adapted to receive an inverted container. An inverted container is threadedly fluidly connected to at least one of the openings, the container having a dispensable liquid therein. A threaded connector, configured to mate with a conventional shower water supply conduit, projects from the spray head body wherethrough pressurized water may be introduced into the showerhead. The new showerhead also includes a selector valve whereby the dispensable liquid in any one of the inverted containers may be selectively mixed with the pressurized water within the showerhead for dispensing therefrom while simultaneously preventing unselected fluids from being dispensed.

6 Claims, 2 Drawing Sheets

SHOWERHEAD WITH SELECTABLE LIQUID DISPENSER

BACKGROUND OF THE INVENTION

1. Field of the Invention

The present invention relates to liquid dispensing devices and more particularly pertains to showerheads with selectable liquid dispenser which may be adapted for selectively dispensing any one of a plurality of viscous liquids such as soap and shampoo available at the showerhead into the water stream of the showerhead during use thereof.

2. Description of the Prior Art

The use of liquid dispensing devices is known in the prior art. More specifically, liquid dispensing devices heretofore devised and utilized for the purpose of dispensing liquid personal care products during a showering activity are known to consist basically of familiar, expected and obvious structural configurations, notwithstanding the myriad of designs encompassed by the crowded prior art which have been developed for the fulfillment of countless objectives and requirements.

The present invention is directed to improving devices for selectively dispensing any one of a plurality of viscous liquids such as soap and shampoo available at the showerhead into the water stream of the showerhead during use thereof in a manner which is safe, secure, economical and aesthetically pleasing.

For example, U.S. Pat. No. 4,998,647 to Sharp discloses a detachable dispenser and hanging support, while U.S. Pat. No. 5,044,522 to Roig et al. shows a shampoo dispenser. Both of these patents disclose similar devices for suspending from the shower head arm having compartments for containing different liquids and nozzles connected to each compartment for dispensing the fluids.

U.S. Pat. No. 5,067,680 to Miller describes a shampoo bottle support device for supporting a bottle of shampoo in an inverted position on a shower wall.

While these devices fulfill their respective, particular objectives and requirements, the aforementioned patents do not disclose a showerhead with selectable liquid dispenser for selectively dispensing one of a plurality of viscous liquids such as soap and shampoo, available at the showerhead, into the water stream of the showerhead during use thereof. Furthermore, both the Sharp and the Roig patents show bulky dispensing devices that hang on the showerhead arm to yield an unstable swinging apparatus located directly under the showerhead within a normally confined area.

The prior art also discloses a shower attachable dispenser as shown in U.S. Pat. No. 4,200,206 to Chase et al. which consists of a fluid dispenser for attachment between a water pipe and a shower head having a main stream water passage therethrough into which dispensed fluids flow through a port surrounded by a delivery manifold delivering the fluids from a reservoir assembly from which the fluids flow through valves. The invention described is attached between the water pipe and showerhead thereby causing the showerhead to project more outwardly and downwardly than is the convention. The showerhead is located in a position to interfere with a person using the shower and to possibly cause injury to a user not familiar with the unusual showerhead placement.

Lastly, U.S. Pat. No. 5,174,503 to Gasaway describes a shower mounted plural liquids dispenser which includes a housing designed to have a plurality of bottles containing diverse liquids coupled to it. The liquids may be dispensed either through the use of aspirating pump structure or through the use of discharge assisting pumping devices. The inventive dispenser also includes a hand-held sprayer controllable by a valve. The shower mounted plural liquids dispenser as described in this patent is a bulky device which uses much premium space within the shower stall. Furthermore, the apparatus is complex and difficult to install requiring specialized tools and knowledge not usually possessed by the average homeowner.

In this respect, the showerhead with selectable liquid dispenser according to the present invention substantially departs from the conventional concepts and designs of the prior art, and in so doing provides an apparatus primarily developed for the purpose of selectively dispensing any one of a plurality of viscous liquids such as soap and shampoo available at the showerhead into the water stream of the showerhead during use thereof.

Therefore, it can be appreciated that there exists a continuing need for new showerheads with selectable liquid dispensers which can be used for selectively dispensing any one of a plurality of viscous liquids such as soap and shampoo available at the showerhead into the water stream of the showerhead during use thereof. In this regard, the present invention substantially fulfills this need.

As illustrated by the background art, efforts are continuously being made in an attempt to develop devices for dispensing liquid personal care products during a showering activity. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of liquid dispensing devices now present in the prior art, the present invention provides a new liquid dispensing device construction wherein the same can be utilized for selectively dispensing any one of a plurality of viscous liquids such as soap and shampoo available at the showerhead into the water stream of the showerhead during use thereof. As such, the general purpose of the present invention, which will be described subsequently in greater detail, is to provide a new showerhead with selectable liquid dispenser apparatus and method which has all the advantages of the prior art liquid dispensing devices and none of the disadvantages.

The invention is defined by the appended claims with the specific embodiment shown in the attached drawings. For the purpose of summarizing the invention, the invention may be incorporated into a new showerhead with selectable liquid dispenser for selectively dispensing any one of a plurality of viscous liquids, such as soap or shampoo, available at the showerhead into the water stream of the showerhead during use thereof. The showerhead with selectable liquid dispenser comprises a generally conical hollow spray head body having a plurality of openings adapted to receive an inverted container. The spray head body also has a plurality of perforations through it's base wherethrough pressurized liquid within the hollow space is forced to produce a shower spray. An inverted container is threadedly fluidly connected to at least one of the openings, the container having a dispensable liquid therein. A threaded connector projects upwardly from the apex of the spray head body. The connector is fluidly connected on one end to the hollow space within the body and has threads on the other end configured to mate with a conventional shower water supply conduit wherethrough pressurized water may be introduced into the showerhead.

The new showerhead also includes selector means whereby the dispensable liquid in one of the inverted containers may be selectively mixed with the pressurized water within the showerhead for dispensing therefrom. The selector means comprises a selector rod rotationally mounted within the hollow space of the spray head body such that the rod rotates on it's longitudinal axis. The selector rod projects through a hole in the side of the spray head body and has an actuator knob formed on one end thereof, external to the spray head body. The selector rod also has a longitudinal bore formed in it's other end, within the spray head body, proximal to the water stream. The selector rod additionally has a lateral aperture therethrough, the lateral aperture being fluidly connected with the longitudinal bore whereby forming a nozzle for injecting fluid into the water stream. A discharge tube, extending downwardly from each of the spray head body openings, is fluidly connected at it's upper end to the spray head body openings wherethrough the dispensable liquid from within the container connected to the opening will flow by force of gravity. The lower ends of the discharge tubes engage the selector rod such that rotation of the actuator knob aligns the lateral aperture with one of the discharge tubes whereby the discharge tube is in fluid communication with the lateral aperture. This allows the selected dispensable fluid to flow through the nozzle while simultaneously sealing the unselected discharge tubes. Further rotation of the actuator knob allows selection of another dispensable fluid while simultaneously preventing unselected fluids from being injected into the shower water stream.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an showerhead with selectable liquid dispenser for selectively dispensing any one of a plurality of viscous liquids such as soap and shampoo available at the showerhead into the water stream of the showerhead during use thereof.

It is another object of the present invention to provide a new showerhead with selectable liquid dispenser which may be easily and efficiently manufactured and marketed.

It is a further object of the present invention to provide a new showerhead with selectable liquid dispenser which is of a durable and reliable construction.

An even further object of the present invention is to provide a new showerhead with selectable liquid dispenser which is susceptible of a low cost of manufacture with regard to both materials and labor, and which accordingly is then susceptible of low prices of sale to the consuming public, thereby making such showerhead with selectable liquid dispensers economically available to the buying public.

Still yet another object of the present invention is to provide a new showerhead with selectable liquid dispenser which provides in the apparatuses and methods of the prior art some of the advantages thereof, while simultaneously overcoming some of the disadvantages normally associated therewith.

Still yet another object of the present invention is to provide a new showerhead with selectable liquid dispenser that is easy for the average person to install with minimal tools.

Yet another object of the present invention is to provide a new showerhead with selectable liquid dispenser that is adapted to dispense liquids directly from the product's original container whereby preventing inadvertent mixing of different products and facilitating rapid identification of available products.

Even still another object of the present invention is to provide a new showerhead with selectable liquid dispenser that is mounted high and out of the way so as not to interfere with normal use of the shower.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
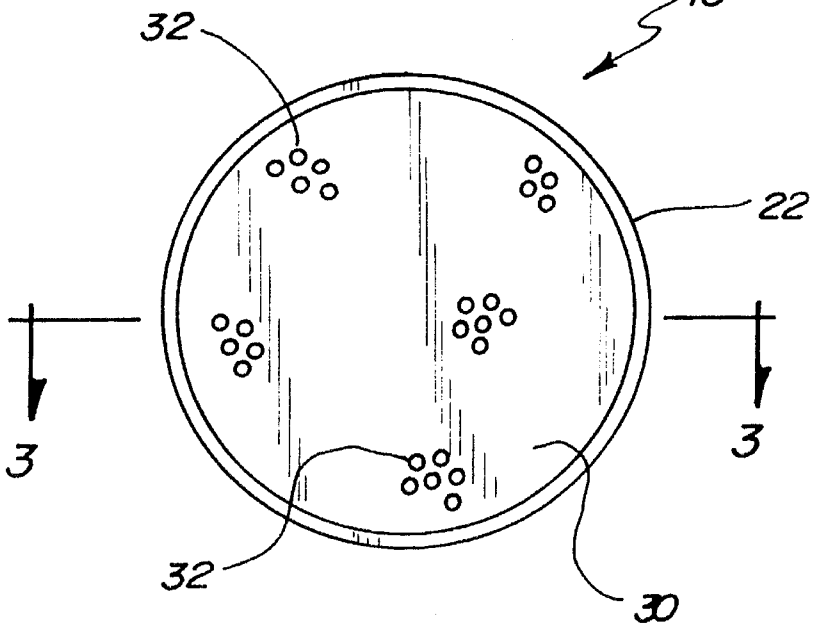
FIG. 2 is a bottom plan view of the invention of FIG. 1.
Figure 1:
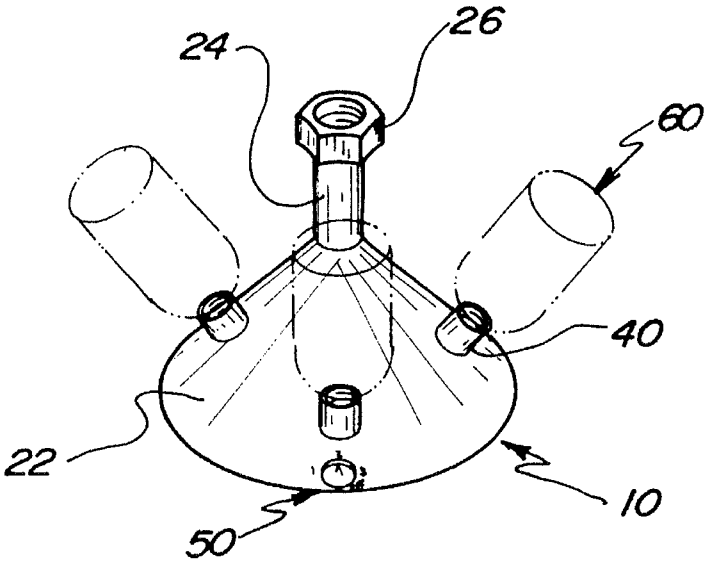
FIG. 1 is a perspective view of the new showerhead with selectable liquid dispenser showing the manner of attachment of the inverted dispensable liquid containers.
Figure 4:
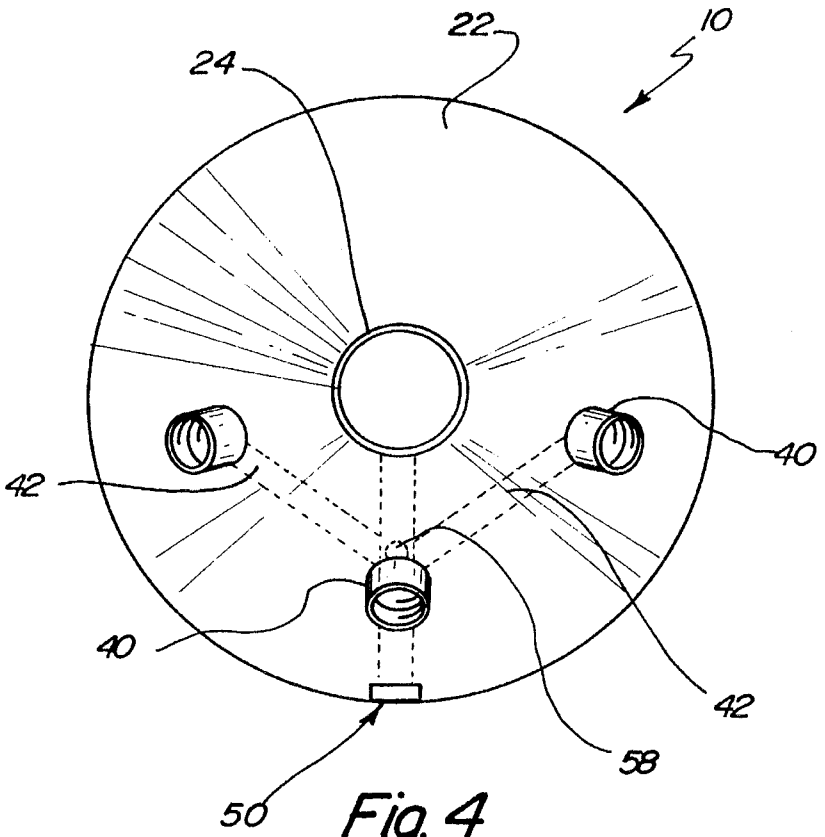
FIG. 4 is a schematic view of the present invention illustrating the manner of operation of the selector valve.

With reference now to the drawings, and in particular to FIG. 1 thereof, a new showerhead with selectable liquid dispenser embodying the principles and concepts of the present invention and generally designated by the reference numeral 10 will be described.

Figure 3:
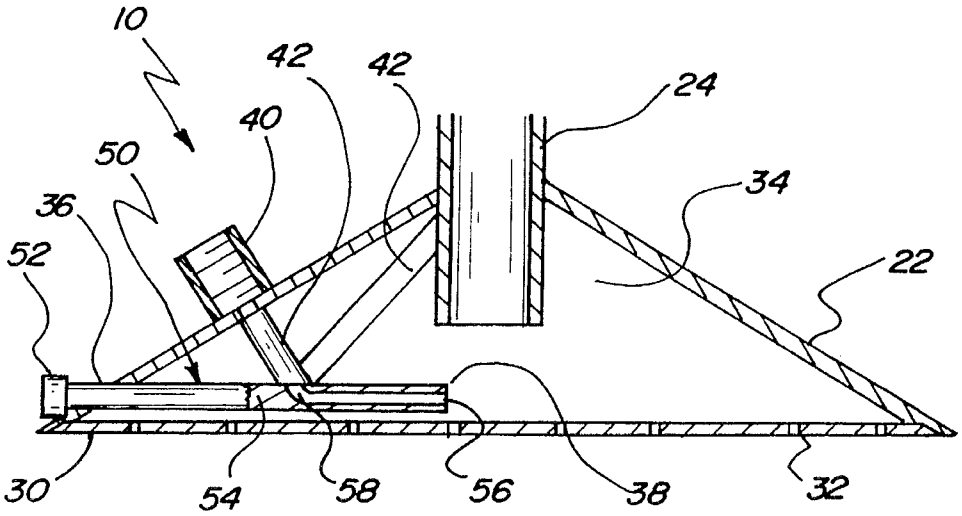
FIG. 3 is a sectional view of the invention of FIG. 2 taken along the line 3—3.

From an overview standpoint, the showerhead with selectable liquid dispenser is adapted for use for selectively dispensing any one of a plurality of viscous liquids such as soap and shampoo, available at the showerhead, into the water stream of the showerhead during use thereof. See FIG. 3.

With reference now to FIGS. 1–4 and more specifically, it will be noted that a new showerhead with selectable liquid dispenser 10 for selectively dispensing one of a plurality of viscous liquids, such as soap or shampoo, available at the showerhead into the water stream of the showerhead during use thereof, is shown. The showerhead with selectable liquid dispenser 10 comprises a generally conical hollow spray head body 22 having a plurality of openings 40 adapted to receive an inverted container 60.

The spray head body 22 also has a plurality of perforations 32 through it's base 30 wherethrough pressurized liquid within the hollow space 34 is forced to produce a shower spray. An inverted container 60 is threadedly fluidly connected to at least one of the openings 40, the container having a dispensable liquid therein. A threaded connector 24 projects upwardly from the apex of the spray head body 22. The connector 24 is fluidly connected on one end to the hollow space 34 within the body 22 and has threads 26 on the other end configured to mate with a conventional shower water supply conduit (not shown) wherethrough pressurized water may be introduced into the showerhead 10.

The new showerhead 10 also includes selector means 50 whereby the dispensable liquid in one of the inverted containers 60 may be selectively mixed with the pressurized water within the showerhead for dispensing therefrom. The selector means 50 comprises a selector rod 54 rotationally mounted within the hollow space 34 of the spray head body 22 such that the rod 54 rotates on it's longitudinal axis. The selector rod 54 projects through a hole 36 in the side of the spray head body 22 and has an actuator knob 52 formed on one end thereof, external to the spray head body 22.

The selector rod 54 also has a longitudinal bore 56 formed in it's other end, within the spray head body, proximal to the water stream. The selector rod 54 additionally has a lateral aperture 58 therethrough, the lateral aperture 58 being fluidly connected with the longitudinal bore 56 whereby forming a nozzle 38 for injecting fluid into the water stream. A discharge tube 42, extending downwardly from each of the spray head body openings 40, is fluidly connected at it's upper end to the spray head body openings 40 wherethrough the dispensable liquid from within the container 60 connected to the opening 40 will flow by force of gravity.

The lower ends of the discharge tubes 42 engage the selector rod 54 such that rotation of the actuator knob 52 aligns the lateral aperture 58 with one of the discharge tubes 40 whereby the discharge tube 40 is in fluid communication with the lateral aperture 58. This allows the selected dispensable fluid to flow through the nozzle 38 while simultaneously sealing the unselected discharge tubes. Further rotation of the actuator knob 52 allows selection of another dispensable fluid while simultaneously preventing unselected fluids from being injected into the shower water stream.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A showerhead with a selectable liquid dispenser for selectively dispensing any one of a plurality of viscous liquids available at the showerhead into the water stream of the showerhead during use thereof, the showerhead with a selectable liquid dispenser comprising:

a generally conical spray head body with a hollow space therein and having a base and an apex and a plurality of openings adapted to receive an inverted container, the spray head body also having a plurality of perforations through the base wherethrough pressurized liquid within the hollow space is forced to produce a shower spray;

an inverted container threadedly fluidly connected to at least one of the openings, the container having a dispensable liquid therein;

a threaded connector projecting upwardly from the apex of the spray head body, the connector being fluidly connected on one end to the hollow space within the body, the connector having threads on the other end configured to mate with a conventional shower water supply conduit wherethrough pressurized water can be introduced into the showerhead;

selector means whereby the dispensable liquid in an inverted container may be selectively mixed with the pressurized water within the showerhead for dispensing therefrom, the selector means comprising;

an elongated selector rod with a longitudinal axis rotationally mounted within the hollow space of the spray head body such that the rod rotates on the longitudinal axis, the selector rod projecting through a hole in the side of the spray head body, the selector rod having an actuator knob formed on a first end thereof external to the spray head body, the selector rod having an actuator knob formed on one end thereof external to the spray head body, the selector rod also having a longitudinal bore formed in a second end thereof within the spray head body proximal to the water stream, the selector rod additionally having a lateral aperture therethrough, the lateral aperture being fluidly connected with the longitudinal bore whereby forming a nozzle for injecting fluid into the water stream; and a discharge tube extending downwardly from each of the spray head body openings, the discharge tubes being fluidly connected at one end to the spray head body openings wherethrough the dispensable liquid from within the container connected to the opening will flow by force of gravity, the other ends of the discharge tubes engaging the selector rod such that rotation of the actuator knob aligns the lateral aperture with one of the discharge tubes whereby the discharge tube is in liquid communication with the lateral aperture thus allowing the selected dispensable liquid to flow through the nozzle while simultaneously sealing the unselected discharge tubes, further rotation of the actuator knob allows selection of another dispensable fluid while simultaneously preventing unselected fluids from being injected into the shower water stream.

2. A showerhead with a selectable liquid dispenser for selectively dispensing any one of a plurality of viscous liquids available at the showerhead into the water stream of the showerhead during use thereof, the showerhead with selectable liquid dispenser comprising:

a spray head body with a hollow space therein and having an apex and a plurality of openings adapted to receive an inverted container, the spray head body being hollow;

an inverted container threadedly fluidly connected to at least one of the openings, the container having a dispensable liquid therein;

a connector fluidly connected on one end to the hollow space within the body, the connector having threads on the other end configured to mate with a conventional shower water supply conduit;

selector means whereby the dispensable liquid in an inverted container can be selectively mixed with the pressurized water within the showerhead for dispensing therefrom while simultaneously preventing dispensable liquid from unselected containers from entering the water stream;

the spray head body being of a generally conical shape; and the connector projecting upwardly from the apex of the spray head body.

3. The showerhead with selectable liquid dispenser of claim 2 wherein the selector means comprises: a selector rod rotationally mounted within the hollow space of the spray head body, the selector rod having a longitudinal bore formed in one end thereof proximal to the water stream, the selector rod additionally having a lateral aperture therethrough, the lateral aperture being fluidly connected with the longitudinal bore; and a discharge tube extending downwardly from each of the spray head body openings the discharge tubes being fluidly connected at one end to the spray head body openings wherethrough the dispensable liquid from within the container connected to the opening will flow by force of gravity, the other ends of the discharge tubes engaging the selector rod such that rotation of the selector rod aligns the lateral aperture with one of the discharge tubes whereby the discharge tube is in fluid communication with the lateral aperture thus allowing the selected dispensable fluid to flow through the longitudinal bore into the water stream while simultaneously sealing the unselected discharge tubes.

4. The showerhead with selectable liquid dispenser of claim 3 wherein the selector rod projects through an aperture in the spray head body.

5. The showerhead with selectable liquid dispenser of claim 4 wherein the selector rod additionally includes an actuator knob formed on one end thereof external to the spray head body.

6. The showerhead with selectable liquid dispenser of claim 5 wherein the selector rod rotates on the longitudinal axis.

* * * * *